US011434070B2

(12) United States Patent
Scholz

(10) Patent No.: US 11,434,070 B2
(45) Date of Patent: Sep. 6, 2022

(54) CARGO OPTIMIZING DEVICE FOR SHIPPING CONTAINERS AND BOX TRUCKS

(71) Applicant: Ingo Scholz, Fort Lauderdale, FL (US)

(72) Inventor: Ingo Scholz, Fort Lauderdale, FL (US)

( * ) Notice: Subject to any disclaimer, the term of this patent is extended or adjusted under 35 U.S.C. 154(b) by 0 days.

(21) Appl. No.: 17/248,278

(22) Filed: Jan. 18, 2021

(65) Prior Publication Data

US 2021/0221605 A1 Jul. 22, 2021

Related U.S. Application Data

(60) Provisional application No. 62/962,462, filed on Jan. 17, 2020.

(51) Int. Cl.
*B65D 90/00* (2006.01)
*A47B 43/00* (2006.01)

(52) U.S. Cl.
CPC ..... *B65D 90/0073* (2013.01); *A47B 43/00* (2013.01)

(58) Field of Classification Search
CPC ..... B65D 21/0201; B65D 19/0067; B65D 2519/00756; B65D 90/004; B65D 90/0073; A47B 43/00
USPC ..... 108/57.19, 57.26, 64, 127, 134
See application file for complete search history.

(56) References Cited

U.S. PATENT DOCUMENTS 3,157,423 A * 11/1964 Brie, Sr. ..... B65D 19/38 294/67.1
4,095,769 A * 6/1978 Fengels ..... B65D 19/0002 108/54.1
5,562,047 A * 10/1996 Forney ..... B65D 19/0002 108/24
6,659,440 B2 * 12/2003 Levy ..... B25H 1/04 269/100

(Continued)

FOREIGN PATENT DOCUMENTS

EP 2955123 A2 * 12/2015 ..... B65D 19/385
EP 3291949 B1 * 8/2019 ..... B25H 1/04

(Continued)

OTHER PUBLICATIONS

International Search Report and Written Opinion; PCT/US21/70705; dated Sep. 27, 2021.

*Primary Examiner* — Patrick D Hawn
(74) *Attorney, Agent, or Firm* — Dunlap Bennett & Ludwig, PLLC; Anna L. Kinney

(57) ABSTRACT

A cargo optimizing device includes a first and a second cargo platform pivotably attached to a center shaft. The first and second cargo platforms have transverse and longitudinal support members. When unfolded into a cargo support configuration, the device forms a planar cargo support. The device has a two-part platform frame in which the members are suspended and can be folded around the central shaft for storage. Support legs are pivotably attached to the frame and retractable rollers extend from the periphery. The device is modular: the transverse members slide to bridge to a second (Continued)

device. The frame and the attached longitudinal members have apertures aligned to accommodate the sliding transverse members. The cargo optimizing device forms a second stacking level in a shipping container which otherwise has an upper level of unused space. The device can be supported by legs or suspended by belts.

7 Claims, 6 Drawing Sheets

(56) References Cited

U.S. PATENT DOCUMENTS 6,761,249 B2 * 7/2004 Garcia ..... A47F 5/13 182/153
6,845,991 B1 * 1/2005 Ritucci ..... B62B 3/007 280/30
7,628,186 B2 * 12/2009 Blum ..... B25H 1/08 108/115
8,403,284 B2 * 3/2013 Korbonski ..... B65D 19/0069 248/346.02
8,534,205 B1 * 9/2013 Johnson ..... A47B 13/08 108/132
8,967,607 B2 * 3/2015 Ducek ..... B27B 5/26 269/289 R
9,357,842 B2 * 6/2016 Gu ..... B25H 1/04
9,580,236 B1 * 2/2017 Skeid ..... B65D 90/54
9,738,295 B1 * 8/2017 Horowitz ..... A47B 3/0818
9,828,172 B2 * 11/2017 Skeid ..... B65D 90/0006
10,336,356 B2 * 7/2019 Dyson ..... B62B 3/02
10,470,561 B2 * 11/2019 Clegg ..... A47B 9/14
10,632,894 B2 * 4/2020 Andre ..... B60P 3/06
10,993,525 B2 * 5/2021 Polidoros ..... A47B 3/08
11,160,366 B2 * 11/2021 Clegg ..... A47B 3/083
11,172,759 B2 * 11/2021 Liu ..... A47B 43/00
2005/0022701 A1 * 2/2005 Choi ..... A47B 3/0912 108/131
2007/0261916 A1 * 11/2007 Sward ..... G01N 33/497 182/129
2011/0203494 A1 * 8/2011 Ashby ..... A47B 3/087 108/127
2014/0190964 A1 * 7/2014 Skeid ..... B65D 88/12 220/1.5
2018/0027963 A1 * 2/2018 Hall ..... B65D 19/00
2019/0001481 A1 * 1/2019 Faibish ..... B25H 1/04
2021/0221605 A1 * 7/2021 Scholz ..... B65D 90/0073

FOREIGN PATENT DOCUMENTS

EP 3689773 A1 * 8/2020 ..... B65D 19/0026
GB 2471969 A * 1/2011 ..... B65D 21/064
GB 2514416 A 11/2014

* cited by examiner

CARGO OPTIMIZING DEVICE FOR SHIPPING CONTAINERS AND BOX TRUCKS

CROSS-REFERENCE TO RELATED APPLICATION

This application claims the benefit of priority of U.S. provisional application No. 62/962,462, filed Jan. 17, 2020, the contents of which are herein incorporated by reference.

BACKGROUND OF THE INVENTION

The present invention relates to shipping containers and, more particularly, to a device making use of otherwise empty space above pallets.

Shipping containers and box trucks get loaded only on a single level—the space above the pallet or load remains empty and unused. Existing solutions are one-way custom-built racks that cannot be reused and must be discarded. Custom-made wood racks require specially treated wood and are very expensive and time intensive to build and to break down for a one-time use.

As can be seen, there is a need for a reusable and cost-effective way to make this space usable for shipping products.

SUMMARY OF THE INVENTION

In one aspect of the present invention, a cargo optimizing device is provided for use in a shipping container. The device comprises a first cargo platform comprising a plurality of transverse support members and a plurality of longitudinal support members; a second cargo platform comprising a plurality of transverse support members and a plurality of longitudinal support members; and a center shaft. The first cargo platform and the second cargo platform are pivotably attached to the center shaft; and wherein the cargo optimizing device forms a substantially planar support operative to support cargo in an unfolded cargo support configuration.

In another aspect of the present invention, a foldable cargo optimizing device is provided. The device comprises a two-part platform frame comprising a center shaft; a plurality of transverse members and a plurality of longitudinal members suspended within the two-part platform frame; a plurality of support legs pivotably attached to the two-part platform frame; and a plurality of retractable rollers extending from a periphery of the two-part platform frame. The foldable cargo optimizing device has a folded storage configuration and an unfolded cargo support configuration.

In another aspect of the present invention, a modular cargo optimizing device is provided. The device comprises a foldable frame pivotable around a central shaft; a plurality of longitudinal members fixedly attached to the foldable frame; a plurality of transverse members slidably attached to the foldable frame and the plurality of longitudinal members; a plurality of legs pivotably attached to the foldable frame. The foldable frame and the plurality of longitudinal members have apertures operative to accommodate the plurality of transverse members and aligned with the plurality of transverse members, such that the foldable frame is operative to slidably bridge to a second foldable frame by way of the plurality of transverse members.

These and other features, aspects and advantages of the present invention will become better understood with reference to the following drawings, description, and claims.

DETAILED DESCRIPTION OF THE INVENTION

Figure 1:
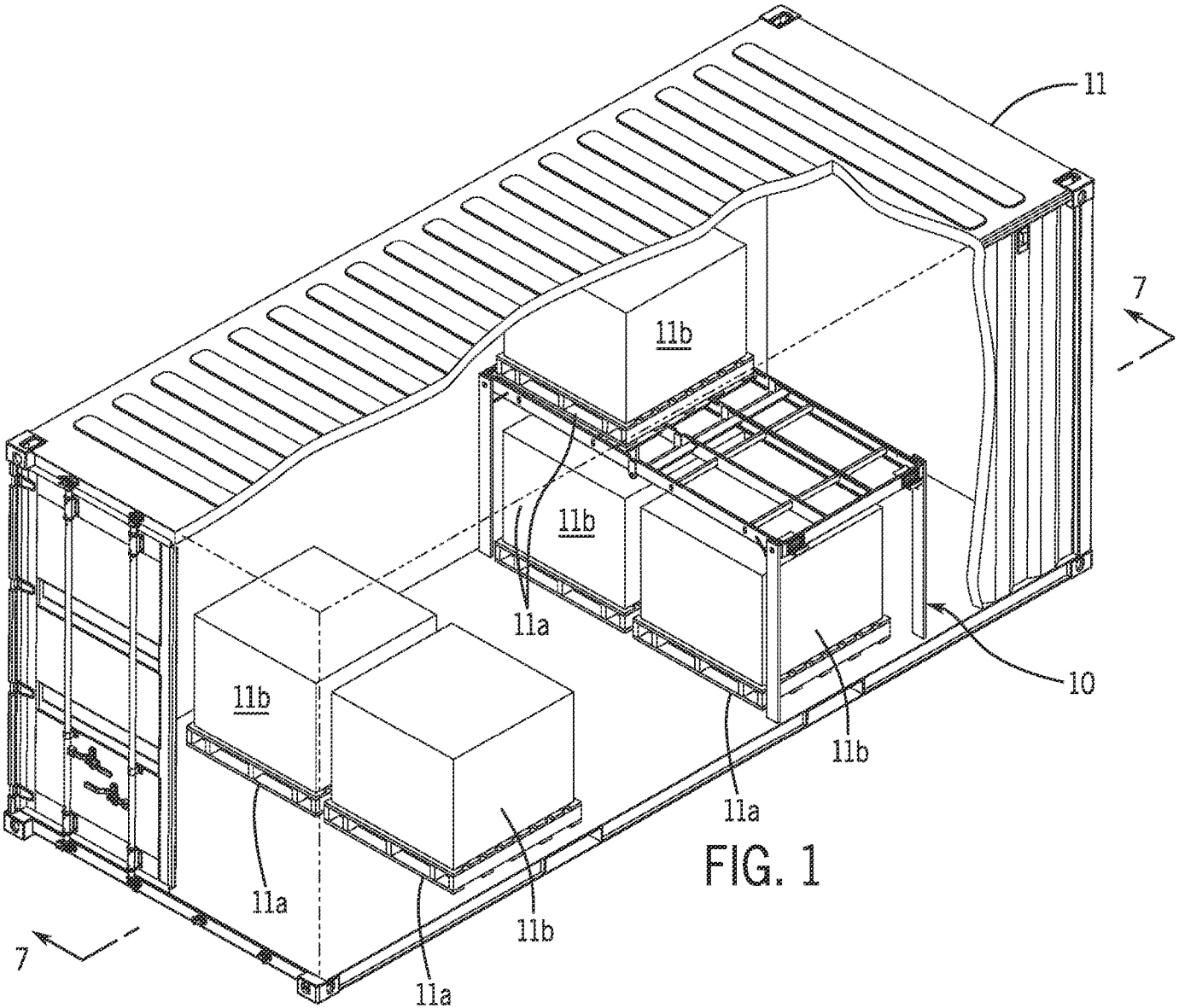
FIG. 1 is a perspective view of a cargo optimizing device according to an embodiment of the present invention, shown with parts broken away.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a fully collapsible stacking rack that fits and/or adjusts to any shipping container and creates a second stacking level in the container. The stacking rack provides a substantially planar support operative to support cargo. The inventive device is reusable, collapsible, and light weight.

In some embodiments, the inventive device comprises a plurality of support legs. The legs provide additional support for higher load weights. In some embodiments, the legs are removable.

In some embodiments, the legs may additionally each be provided with a hinged foot. In other words, the foot may be hingedly attached to the leg.

The inventive rack may comprise a collapsible frame with longitudinal support members.

In some embodiments, the inventive rack may further comprise grid components between bars. The grid components allow small packages to be loaded on top of the device without falling through. In some cases, the grid components may be removably suspended from the bars.

The rack is generally light weight and may quickly and easily install in any container. Containers may include, for example, shipping containers, tilt trailers, plain trucks, and box trailers. The rack may securely stand in the container or it may be hung with attached straps. As many as about 6 devices may be positioned adjacent to each other in a 40-foot trailer.

The materials of manufacture are not particularly limited. The inventive cargo optimizing device may be manufactured from at least one material selected from but not limited to: aluminum, wood, and steel. The dimensions of height, width or depth may be altered. The inventive rack device may be assembled from a plurality of parts, which may include straps and cables.

In some embodiments, the rack may be hinged midway along the length of the device, such that the device may fold along the width of the rack. To open the foldable frame from a folded configuration, hinges may be provided on both side ends, with securing means that engage once the frame is in a predetermined position. For example, once the legs are unfolded, another set of hinges are locked into place to secure the legs at each corner, such as foldable leg brackets operative to releasably lock the legs into position.

The cargo optimizer device may either be positioned to stand on its legs, or on feet if provided, or it may be suspended from mounting rings in the container, such as the safety hooks of a sea container, and adjusted to a predetermined height by means of adjusting the straps. The device may be secured against slipping by means of adjustable rollers. The rollers may be attached to the periphery of the device frame at opposing ends and may extend to fit snugly in the container wall recesses, which are present in each container. For example, the rollers may extend about 1 inch to either side of the device to securely fit within the container wall recesses, preventing lateral movement of the device. Once installed, the device provides a second level to load pallets and goods. One end of each strap is firmly connected, or fixedly attached, to the cargo optimizer. The other end of each strap may have a hook for hanging in the container eye.

In some embodiments, the cargo optimizing device may have a bridge component, allowing two modular cargo optimizing devices to be linked. For example, the bridge component may comprise transverse support members slidably attached to the frame. The bridge may be extended from one cargo optimizer to another in an extended configuration and secured by inserting the bridge into indentations in the second cargo optimizing device. For example, the transverse support members may extend through apertures in the frame of the second cargo optimizing device. The apertures may have any suitable size that accommodates the transverse support members. The apertures may be aligned to the transverse support members.

In between uses, the user may dismantle the device by merely removing the tie down straps and cables and folding the device for storage or reuse. The adjustable belt is attached to the side of the cargo optimizer after use. In some embodiments, the adjustable belt comprises a steel cable.

Referring to FIGS. 1 through 11, FIG. 1 shows a shipping container 11 cut away to show pallets 11*a* supporting cargo 11*b* with and without a cargo optimizing device 10 according to an embodiment of the present invention.

Figure 2:
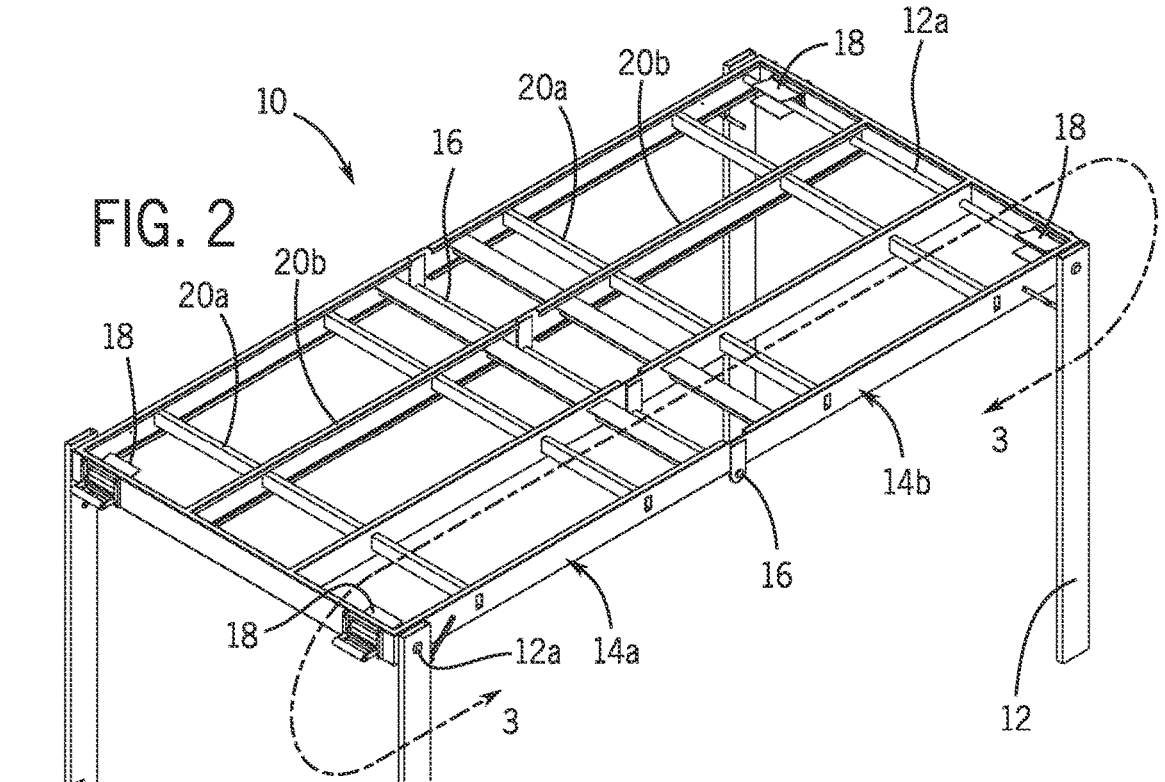
FIG. 2 is a perspective view of the frame thereof.
Figure 3:
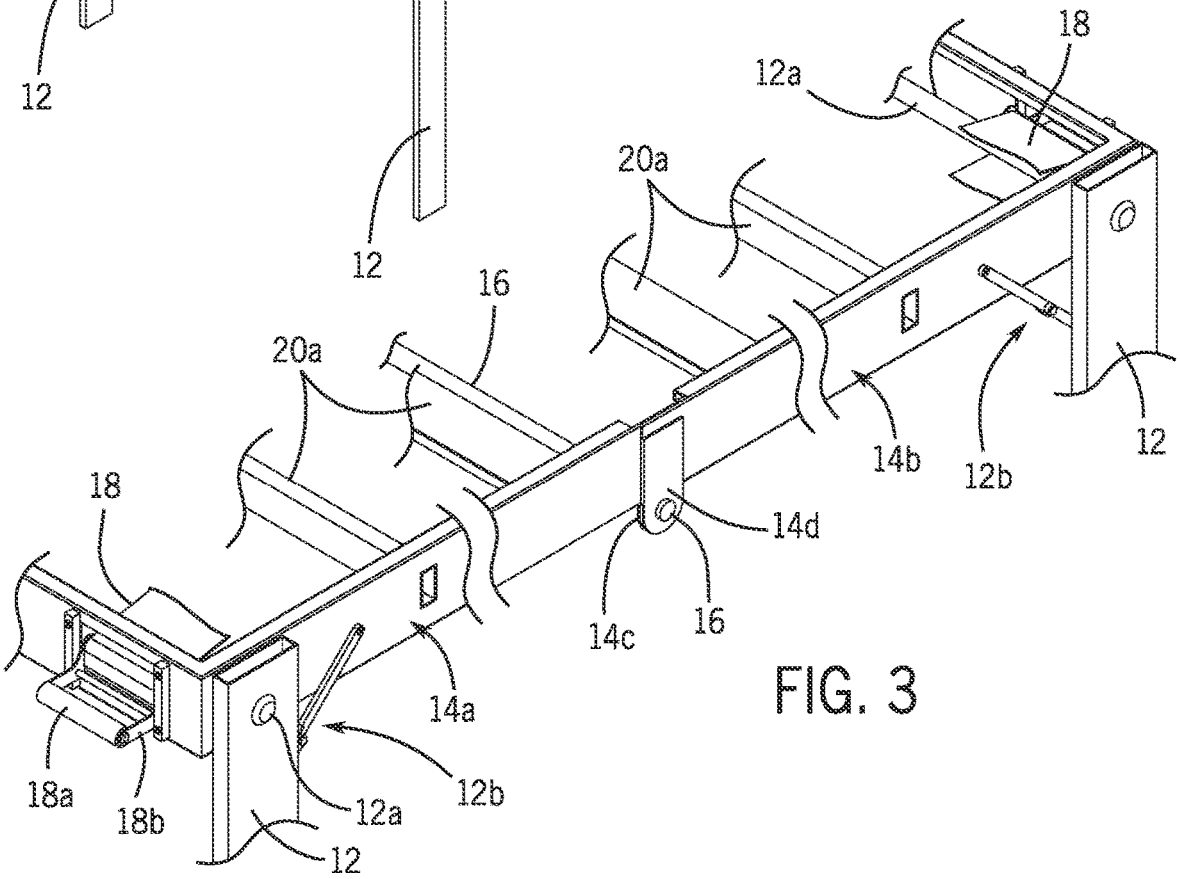
FIG. 3 is a detail perspective view thereof, taken along line 3-3 of FIG. 2.

FIGS. 2 and 3 illustrate an embodiment of the cargo optimizing device 10 having a plurality of legs 12, shown in an unfolded cargo support configuration for use. The legs 12 join the device at leg shafts 12*a* and are locked in position during use with folding leg brackets 12*b*. The cargo optimizing device includes a two-part platform frame comprising a first cargo platform 14*a* and a second cargo platform 14*b*, each platform pivotably joined at a center shaft 16 with a center shaft pivot bracket 14*c*, 14*d*. The central shaft 16 may be secured by the weight of cargo positioned on top of the device. Each platform 14*a*, 14*b* comprises transverse rack slats or transverse members 20*a* extending through longitudinal members 20*b*. In some embodiments, the transverse members 20*a* may slide through apertures in the longitudinal members 20*b*, extending as a connection bridge, extension rack, or cargo bridge to attach two cargo optimizing devices 10 together. Adjacent to each leg 12, each platform 14*a*, 14*b* comprises an extendable roller 18*a* connected by a roller holder 18*b*, as well as a tie-down strap or belt 18 fixedly attached to the device 10. The belt 18 may be adjustable in length and may have a hook (not shown) at a distal end. The rollers 18*a* may be retracted or may be extended to contact the walls of a cargo container.

Figure 4:
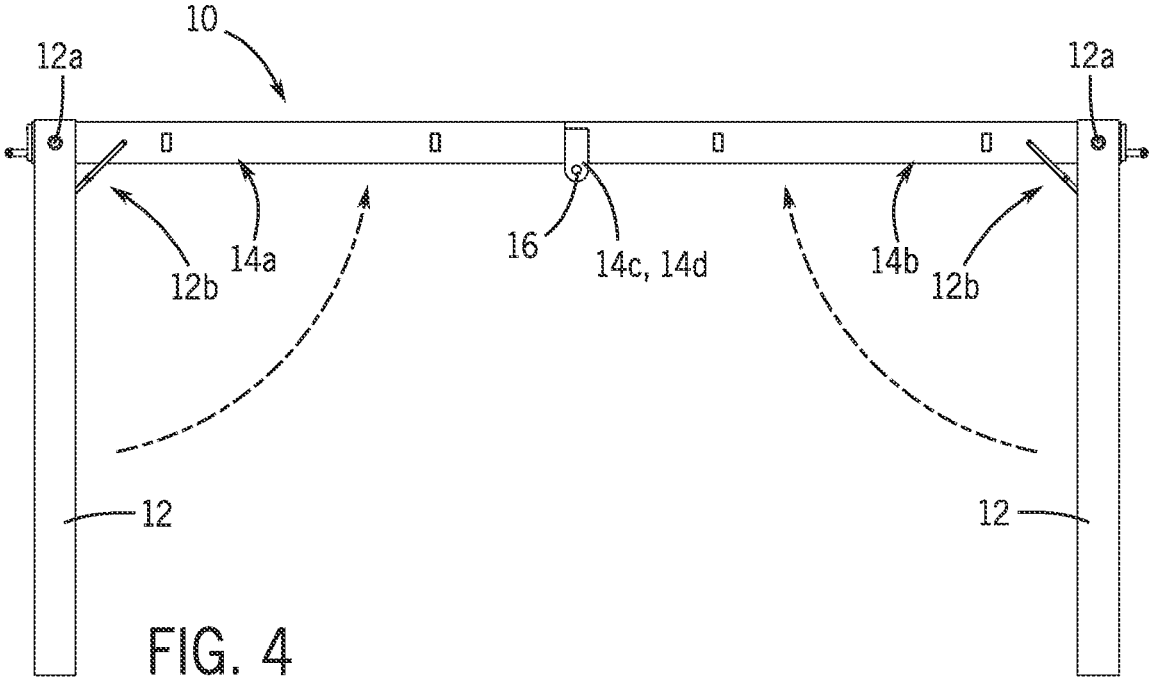
FIG. 4 is a side elevation view thereof.
Figure 5:
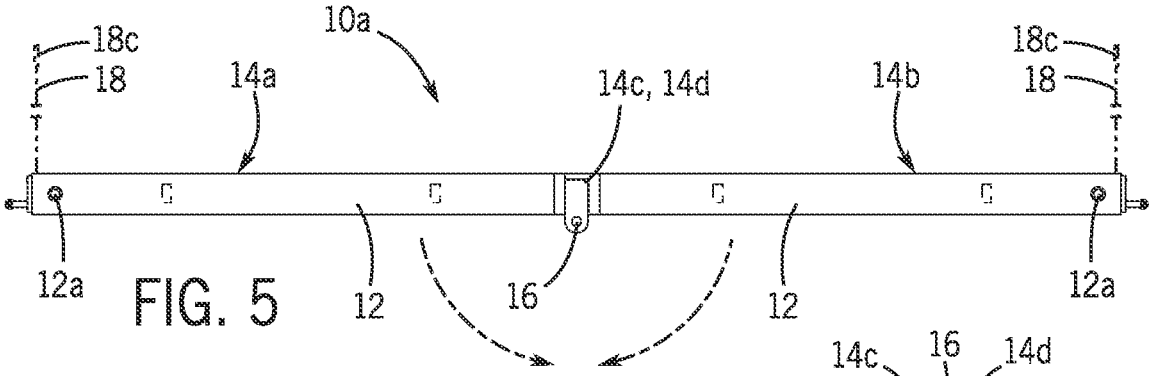
FIG. 5 is a side elevation view thereof, shown in a suspended configuration without legs.
Figure 6:
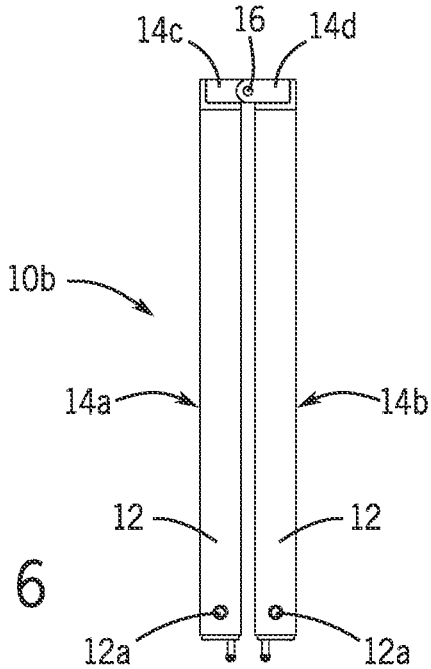
FIG. 6 is a side elevation view thereof, shown in a folded, storage configuration.

FIGS. 4 through 6 illustrate steps of folding the cargo optimizing device 10. Embodiments of the inventive device 10 having legs 12 may be folded in tandem at the leg shafts 12*a*. The first and second platforms 14*a*, 14*b* may be folded together at the center shaft 16. The cargo optimizing device 10*b* is foldable into a storage configuration shown in FIG. 6 and may be stored for future use.

Figure 7:
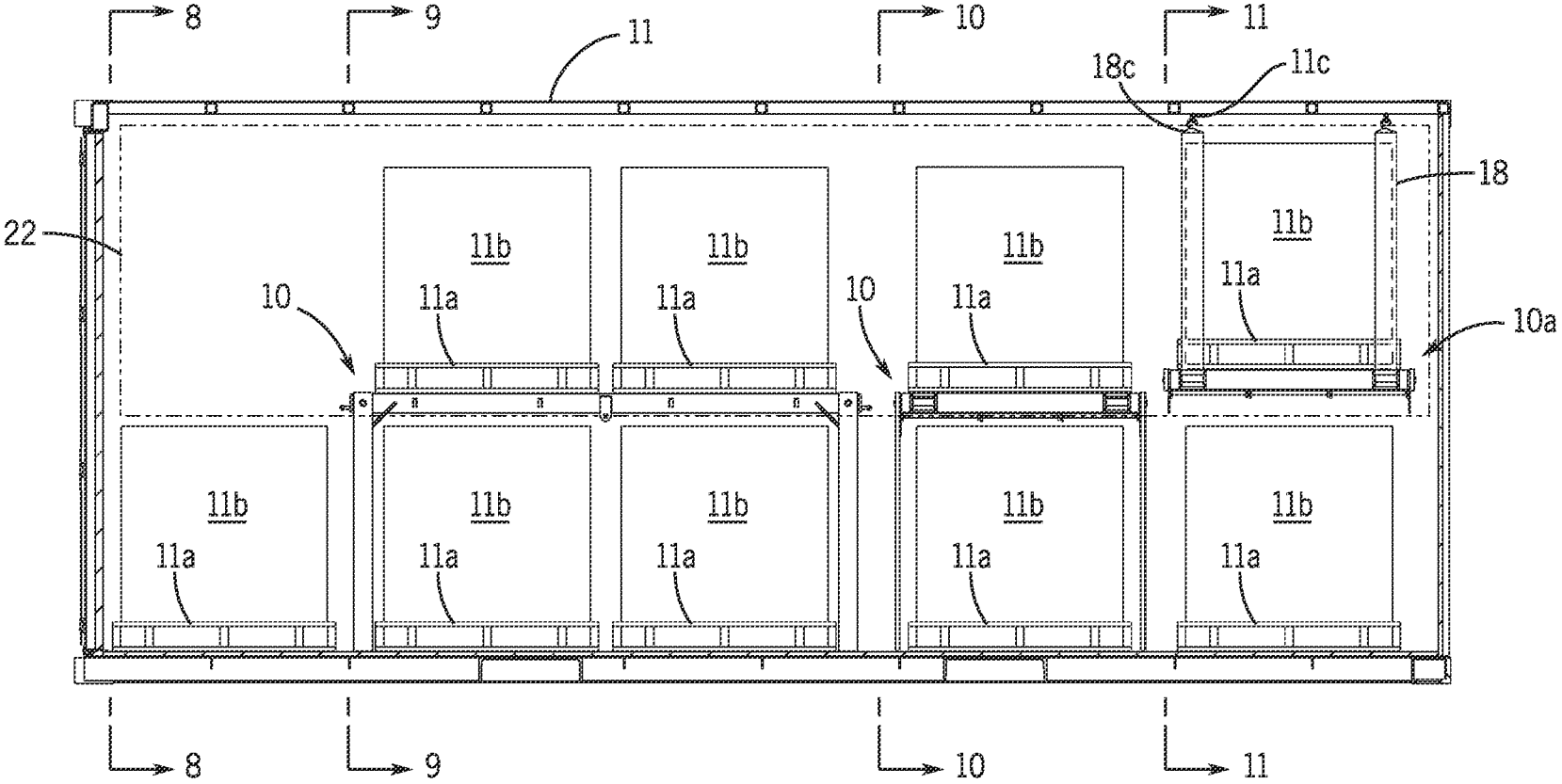
FIG. 7 is a cross-sectional view thereof, taken along line 7-7 of FIG. 1.
Figure 8:
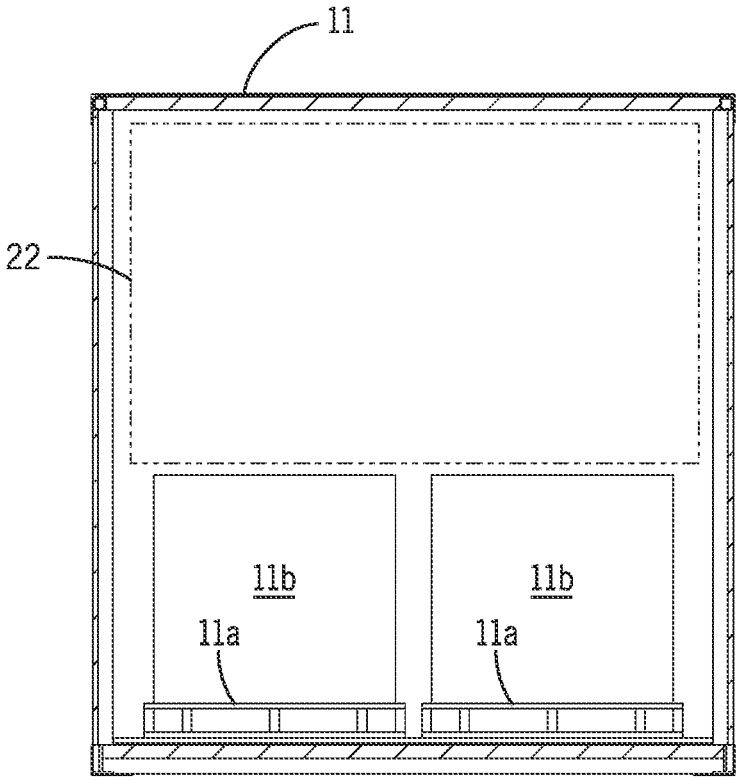
FIG. 8 is a cross-sectional view thereof, taken along line 8-8 of FIG. 7.
Figure 9:
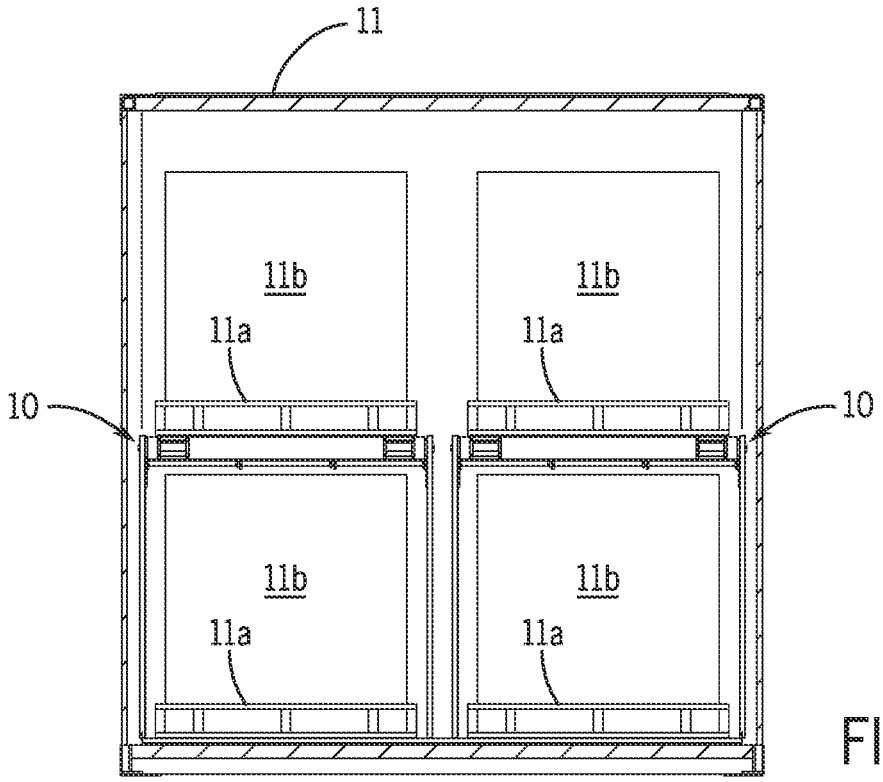
FIG. 9 is a cross-sectional view thereof, taken along line 9-9 of FIG. 7.
Figure 10:
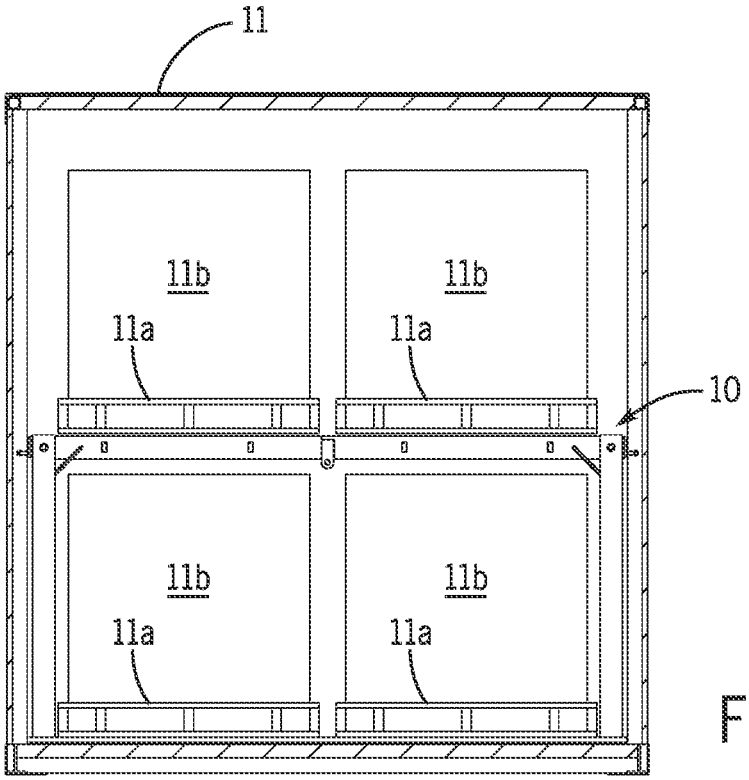
FIG. 10 is a cross-sectional view thereof, taken along line 10-10 of FIG. 7.
Figure 11:
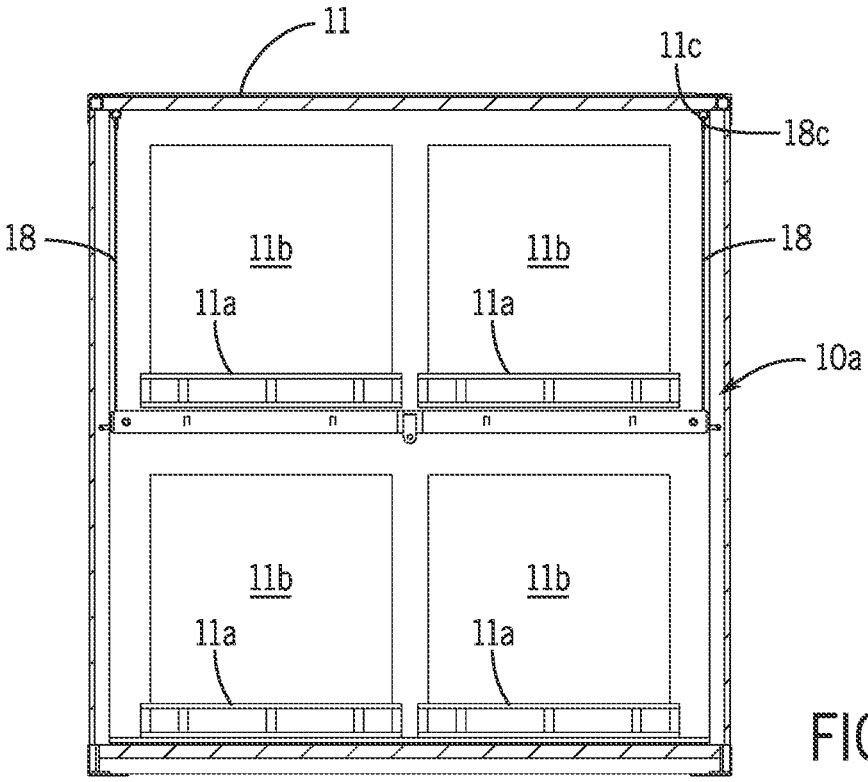
FIG. 11 is a cross-sectional view thereof, taken along line 11-11 of FIG. 7.

FIG. 7 is a sectional view of FIG. 1, showing a shipping container 11 with multiple embodiments of the inventive cargo optimizing device 10, 10*a* in various configurations supporting pallets 11*a* with cargo 11*b*, effectively providing a double layer of cargo. FIGS. 8 through 11 are sectional views of the FIG. 7 shipping container 11, illustrating the cargo optimizing devices 10, 10*a*. FIG. 8 shows a portion of the shipping container 11 without the cargo optimizing device 10, showing unused space 22 above cargo 11*b* on pallets 11*a*. FIG. 9 shows a pair of the cargo optimizing devices 10 side by side widthwise within the shipping container 11, each straddling a pallet 11*a* loaded with cargo 11*b*. A second set of pallets 11*a* loaded with cargo 11*b* are shown on top of the cargo optimizing devices, making use of the otherwise unused space 22. FIG. 10 shows an embodiment of the cargo optimizing device 10 having legs in use within the shipping container 11. A pair of pallets 11*a* supporting cargo 11*b* are shown on the container 11 floor, below the cargo optimizing device 10. A second pair of pallets 11*a* supporting cargo 11*b* are shown on top of the cargo optimizing device 10. FIG. 11 shows an embodiment of the cargo optimizing device 10*a*, without legs, suspended with belts 18 from belt hooks 18*c* connected to the container eyes 11*c*.

It should be understood, of course, that the foregoing relates to exemplary embodiments of the invention and that modifications may be made without departing from the spirit and scope of the invention as set forth in the following claims.

What is claimed is:

1. A cargo optimizing device for use in a shipping container, comprising:

a. a first cargo platform comprising a plurality of transverse support members and a plurality of longitudinal support members;

b. a second cargo platform comprising a plurality of transverse support members and a plurality of longitudinal support members; and c. a center shaft;

wherein the first cargo platform and the second cargo platform are pivotably attached to the center shaft; and wherein the cargo optimizing device forms a substantially planar support operative to support cargo in an unfolded cargo support configuration;

further comprising extendable rollers attached at opposing edges of the first cargo platform and the second cargo platform and belts fixedly attached at opposing edges of the first cargo platform and the second cargo platform, such that said belts and said extendable rollers are co-located, and wherein said extendable rollers when in an extended position are operative to snugly secure the cargo optimizing device within the shipping container.

2. The cargo optimizing device of claim 1, wherein the plurality of transverse support members are slidably attached to the plurality of longitudinal support members and are operative as a connection bridge in an extended configuration.

3. The cargo optimizing device of claim 1, further comprising a plurality of legs pivotably attached to the first cargo platform and the second cargo platform.

4. The cargo optimizing device of claim 3, wherein the plurality of legs further comprise foldable leg brackets operative to releasably lock the plurality of legs in an unfolded cargo support configuration.

5. A foldable cargo optimizing device, comprising:

a. a two-part platform frame comprising a center shaft;

b. a plurality of transverse members and a plurality of longitudinal members suspended within the two-part platform frame;

c. a plurality of support legs pivotably attached to the two-part platform frame;

d. a plurality of retractable rollers extending from a periphery of the two-part platform frame and e. a belt co-located with each of the plurality of retractable rollers and attached to the two-part platform frame;

wherein the foldable cargo optimizing device has a folded storage configuration and an unfolded cargo support configuration and wherein, in the unfolded cargo support configuration, the plurality of retractable rollers is extended and is operative to engage with sidewalls of a cargo container.

6. The foldable cargo optimizing device of claim 5, wherein the plurality of transverse members are slidably attached to the plurality of longitudinal members and slidably suspended within the two-part platform frame.

7. A modular cargo optimizing device, comprising:

a. a foldable frame pivotable around a central shaft;

b. a plurality of longitudinal members fixedly attached to the foldable frame;

c. a plurality of transverse members slidably attached to the foldable frame and the plurality of longitudinal members; and d. a plurality of legs pivotably attached to the foldable frame;

wherein the foldable frame and the plurality of longitudinal members have apertures operative to accommodate the plurality of transverse members and aligned with the plurality of transverse members, such that the foldable frame is operative to slidably bridge to a second foldable frame by way of the plurality of transverse members; and wherein an extendable roller and a belt are co-located on the foldable frame adjacent to each of the plurality of legs.

* * * * *